United States Patent [19]

Kobler

[11] Patent Number: 4,913,673

[45] Date of Patent: Apr. 3, 1990

[54] HERMETICALLY SEALED CONNECTOR

[75] Inventor: Robert J. Kobler, Harrisburg, Pa.

[73] Assignee: AMP Incorporated, Harrisburg, Pa.

[21] Appl. No.: 355,132

[22] Filed: May 16, 1989

Related U.S. Application Data

[63] Continuation of Ser. No. 226,333, Jul. 29, 1988, abandoned.

[51] Int. Cl.[4] ..... H01R 13/405

[52] U.S. Cl. ..... 439/736

[58] Field of Search ..... 439/548, 549, 553, 556, 439/559, 722, 735, 736, 935, 936

[56] References Cited

U.S. PATENT DOCUMENTS

| | | | |
|---|---|---|---|
| 2,383,909 | 8/1945 | Buchanan . | |
| 3,495,028 | 2/1970 | Tutthill | 439/559 |
| 3,522,575 | 8/1970 | Watson et al. . | |
| 3,696,321 | 10/1972 | Cooper, Jr. | 439/722 |
| 3,708,612 | 1/1973 | Saxon et al. | 439/736 |
| 3,747,048 | 7/1973 | Johnson et al. . | |
| 3,977,750 | 8/1976 | Glover et al. . | |
| 4,280,747 | 7/1981 | Kinzler | 439/556 |
| 4,356,344 | 10/1982 | Carey | 439/736 |
| 4,480,151 | 10/1984 | Dozier | 439/736 |

OTHER PUBLICATIONS

IEEE Transactions on Components, Hybrids, and Manufacturing Technology, vol. CHMT-7, No. 3, Sep. 1984; pp. 276-280, Kokini et al., "Estimating the Strength of Annular Glass-to-Metal Seals in Microelectronic Packages: An Experimental Study".

Article, "Glass-to-Metal Improved Yields and Quality Using Nitrogen-Based Atmospheres," Schmidt et al, pp. 208-212; (source unknown).

*Primary Examiner*—Gary F. Paumen

*Attorney, Agent, or Firm*—Anton P. Ness

[57] ABSTRACT

A hermetically sealed high voltage electrical connector is provided which includes a metal support member having one or more apertures therein for receiving one or more electrical contacts. The contacts are mounted within the apertures by plastic contact-retention means which supports the contacts within the apertures and provides a hermetic seal between the contacts and the support member. The plastic contact-retention means includes plastic plug portions in the apertures; and the contacts, preferably, include one or a spaced pair of flange portions to increase the area of the bonding surface at the interface between the plastic plugs and the contacts. A metal-to-plastic adhesive may be applied at the interface between the plugs and the side walls of the apertures for enhanced bonding therebetween. According to a preferred embodiment, the connector comprises an interface connector; and the plastic contact-retention means also includes a covering portion covering substantially the entire connector except for an annular flange portion extending outwardly and adapted to be connected to an external housing. The present invention provides a reliable hermetically sealed connector that does not require ceramic sealing plugs, resulting in a lower cost connector that can be manufactured at substantially reduced temperatures.

12 Claims, 2 Drawing Sheets

HERMETICALLY SEALED CONNECTOR

This application is a Continuation of Application Ser. No. 07/226,333 filed July 29, 1988, now abandoned.

FIELD OF THE INVENTION

The present invention relates generally to electrical connectors and, more particularly, to hermetically sealed, electrical connectors for high voltage and other applications.

BACKGROUND OF THE INVENTION

Many electrical connector applications require the use of hermetically sealed connectors, i.e., connectors having a hermetic seal between the one or more electrical contacts of the connectors and the panel or other support member through which the contacts extend. One important application for hermetically sealed connectors is in interface connectors for high-voltage applications. The hermetic seal must be maintained through many cycles of high and low temperature during in-service use, necessitating the use of diverse materials which must have about the same coefficient of thermal expansion.

Known hermetically sealed interface connectors may comprise a plastic tubular housing including an integrally molded transverse wafer having a plurality of contact pins extending through and supported within a plurality of apertures in the wafer. Generally, interface connectors are mounted to an outer metallic housing or can, and with this type of plastic connector it was necessary to attach such as by insert molding techniques a separate metal flange around the plastic housing to provide for mechanical connection to the can. An example of such a prior art plastic interface connector is disclosed in U.S. Pat. No. 3,522,575. One feature disclosed in this reference is the use of flanges or recesses along the portion of the contact embedded in the plastic, which provides an elongated length along which a path would have to be opened to result in leaks, and which provides a greater bonding surface; the reference also discloses a particular technique for enhancing the bond between the contact and the plastic.

Another known type of interface connector utilizes a housing of an electrically conductive metal such as KOVAR iron/nickel/cobalt alloy (trademark of Carpenter Technology Corporation) in which the housing can be directly soldered to the can along an integral flange portion, avoiding the necessity of a separate metal flange. In interface connectors incorporating metal wafers, the individual contact pins were retained within apertures in the transverse metal wafer by glass or ceramic plugs which supported the contacts and provided a hermetic seal between the contacts and the side walls of the apertures.

Glass plugs provide a reliable hermetic seal. The type of glass such as borosilicate, and the type of metal such as KOVAR, however, are relatively expensive materials; and manufacture of connectors with glass plugs requires the attainment of very high temperatures in several stages of manufacture: to decarburize or drive off carbon from the metal; to form a thick enough oxide layer on the metal; and to melt the glass preform in the plate aperture and about the contact to form a hermetic seal with the oxide layer.

SUMMARY OF THE INVENTION

The present invention provides a hermetically sealed high voltage electrical connector which comprises a tubular metal support member including an integral outwardly extending peripheral flange and a transverse plate-like portion having one or more apertures extending therethrough, an electrical contact extending through each of the one or more apertures, and plastic contact-retention means within the one or more apertures for retaining the contacts within the apertures and for providing a hermetic seal between the contacts and the metal support member.

In accordance with the present invention, the plastic contact-retention means comprises a moldable thermosetting dielectric material which is molded in place within the apertures and around the contacts to form plastic sealing plugs which are effective in supporting the contacts within the apertures and in providing a hermetic seal between the contacts and the side walls of the apertures. By the present invention, accordingly, a hermetically sealed electrical connector is provided which uses relatively low-cost, moldable plastic materials rather than more expensive ceramic, and which can be manufactured at significantly lower temperatures than connectors using ceramic sealing plugs, and in a simpler, more economic process. The plastic material generally has a coefficient of thermal expansion closer to that of metal than do glass or ceramic materials.

According to a presently preferred embodiment, the one or more electrical contacts comprise contact pins having one or more enlarged, flange portions to increase the area of the bonding surface between the contacts and the plastic contact-retention means to provide a more reliable seal at the interface therebetween. Preferably, also, a suitable plastic-to-metal adhesive is applied at the interface between the plastic contact-retention means and the adjacent portions of the contacts as well as the side walls of the apertures for enhancing the seal therebetween.

According to one embodiment of the invention, the plastic contact-retention means comprises individual plastic sealing plugs molded within the one or more apertures of the transverse plate-like portion of the tubular support member. In an alternative embodiment, the plastic contact-retention means comprises a molded body which is molded around substantially the entire metal support member to define plastic sealing plug portions in each aperture interconnected by a plastic cover portion covering substantially the entire outer surface of the support member except for the outer metal flange which is left uncovered for connection to a can such as by soldering. Using contacts with a pair of flanges axially spaced above and below the transverse plate portion of the support member in the molded body embodiment eliminates the problem of thin-walled portions in the plastic contact-retention means that can prevent proper molding. In either embodiment, the connector of the invention uses standard support members and maintains standard center-line spacing between contact pins in the connector for proper mating with a standard complementary connector.

Further features and advantages of the invention will become apparent hereinafter in conjunction with the following detailed description of presently preferred embodiments, with reference to the accompanying drawings.

DETAILED DESCRIPTION OF THE PREFERRED EMBODIMENTS

Figure 1:
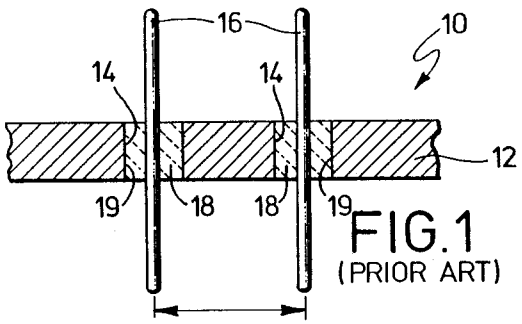
FIG. 1 (PRIOR ART)
FIG. 1 is a longitudinal sectional view of a portion of a hermetically sealed electrical connector of the prior art.

FIG. 1 is a cross-sectional view illustrating a portion of a hermetically sealed electrical connector of known construction to facilitate an understanding of the present invention. The connector is generally designated by reference numeral 10 and includes a contact support member 12 comprising a flat metal plate. Support member 12 includes a plurality of apertures 14 (two of which are shown in FIG. 1) and a plurality of electrical pin contacts 16 which extend through the apertures 14. Contacts 16 extend through a plurality of ceramic plugs 18 which are positioned within apertures 14 to mount the contacts to support member 12 and to provide a hermetic seal between the contacts and side walls 19 of the apertures. The support member 12 is of the type free of any flanges or similar structures extending axially outwardly from the peripheries of the apertures 14 and along portions of contacts 16.

To manufacture connector 10, metal support member 12 is heated, causing it to expand. The ceramic is then placed in apertures 14 with contacts 16 extending substantially centrally through the ceramic. Support member 12 is then cooled; and as it cools, it contracts, squeezing the ceramic within the apertures and creating a tight, hermetic seal between contacts 16 and member 12.

Although ceramic plugs 18 provide a reliable hermetic seal, ceramic is a relatively expensive material. Also, severely high temperatures must be attained during manufacture of the connector. These disadvantages are avoided by the hermetically sealed electrical connectors of the present invention.

Figure 2:
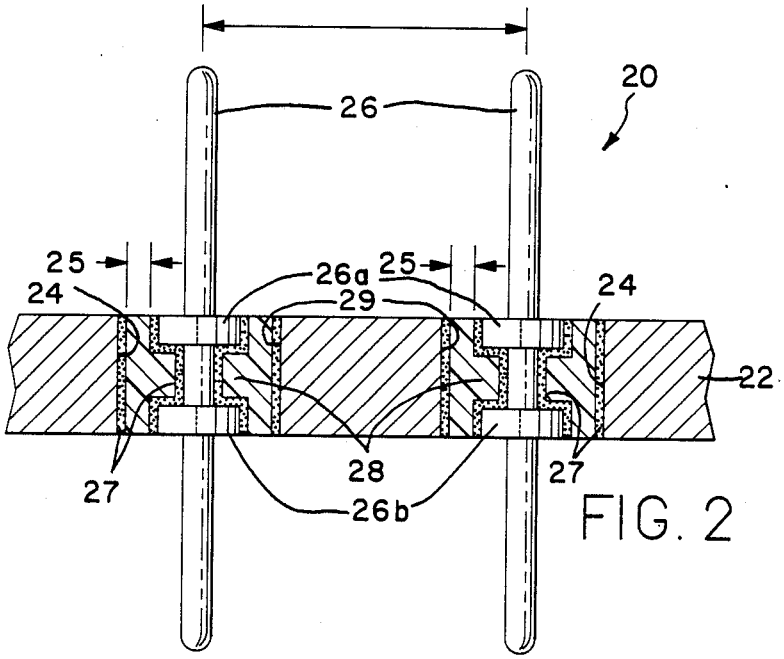
FIG. 2 is a longitudinal sectional view of a portion of a hermetically sealed electrical connector according to one embodiment of the present invention.

FIG. 2 illustrates a portion of a hermetically sealed electrical connector 20 according to one embodiment of the invention. Connector 20 comprises a metal contact support member 22 which can be identical to support member 12 in FIG. 1. Support member 22 contains a plurality of apertures 24 (two of which are shown in FIG. 2) and a plurality of electrical contact pins 26 which extend through apertures 24. Contacts pins 26 are supported within apertures 24 by contact-retention means which comprises a plurality of plastic plugs 28 which support the contacts within the apertures and provide a hermetic seal between the contacts and the side walls 29 of the apertures.

Plugs 28 are molded from any suitable, moldable, thermosetting dielectric material and are preferably molded in place within apertures 24. More particularly, contact pins 26 are positioned to extend centrally through the apertures; and plastic material is placed in the apertures and molded in place therein to form plugs 28.

Plastic plugs 28 are highly effective in providing a hermetic seal between contacts 26 and support member 22. Furthermore, the moldable plastic material of which plugs 28 are formed is typically less expensive than ceramic and can be molded at a substantially lower temperature than is required to manufacture connectors which are sealed by ceramic plugs.

To achieve a more reliable hermetic seal at the interface between contact pins 26 and plastic plugs 28, the contact pins are preferably formed to include one or more enlarged flange portions such as illustrated at **26*a* and 26*b* in FIG. 2. Flange portions 26*a* and 26*b* provide an increased bonding surface area at the interface between the contacts and the plastic plugs to ensure a reliable hermetic seal therebetween. Preferably also, a suitable metal-to-plastic adhesive is applied between the plugs and the side walls 29 of the apertures and between the plugs and the adjacent contact portions as shown at 27** to provide an enhanced seal at that interface. One such adhesive is a coating of phenolic resin having about six percent polyvinyl chloride therein, as disclosed in U.S. Pat. No. 3,522,575.

In a presently preferred embodiment, metal support member 22 comprises brass or a suitable steel alloy such as a nickel/iron alloy. The contact pins may comprise a copper alloy which is conventionally plated with gold over nickel at the pin contact sections, as is known in the art. Although in the embodiment of FIG. 2, contacts 26 comprise pin contacts, other contact types can also be used, if desired.

Figure 3:
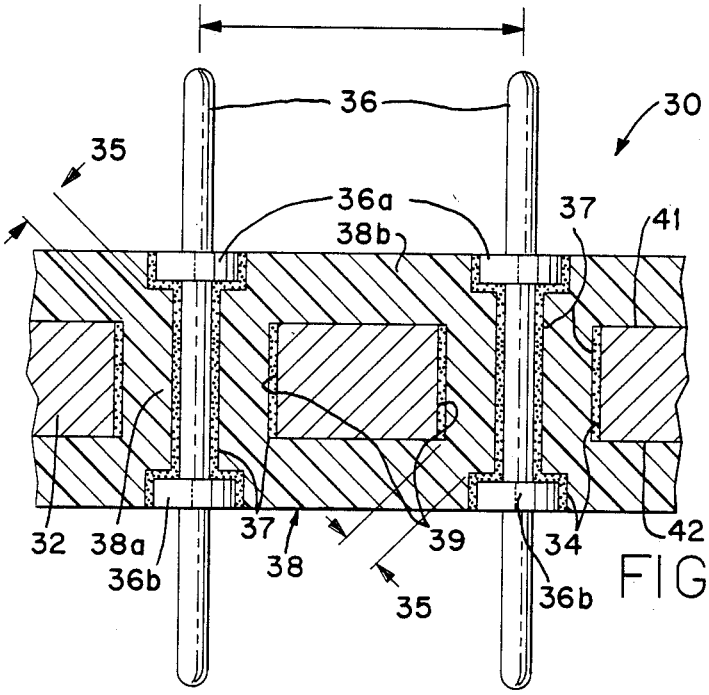
FIG. 3 is a longitudinal sectional view of a portion of a hermetically sealed, electrical connector according to an alternative embodiment of the invention.

FIG. 3 illustrates an alternative, presently most preferred embodiment of the invention. In the embodiment of FIG. 2, electrical and molding problems sometimes occur because of insufficient thickness of portions of plastic plugs 28. For example, in FIG. 2, the thickness of the plastic material between flange portions 26a and 26b of contacts 26 and side walls 29 of apertures 24 (as indicated at 25) may be insufficient for proper molding. In manufacturing connector 20, however, it is desirable to use standard support members having standard-sized apertures and to maintain standard center line spacing between contact pins for proper mating with standard, complementary connectors. Accordingly, to increase aperture size or to otherwise alter support member 12 to avoid thin walls in the plastic plugs is undesirable. Excessively thin walls, however, are avoided in the embodiment of FIGS. 3 and 4.

FIG. 3 illustrates a portion of a hermetically sealed connector 30 which includes a tubular metal support member 32 having a plurality of apertures 34 and a plurality of electrical contact pins 36 extending through the apertures. Support member 32 is identical to support members 12 and 22 in FIGS. 1 and 2, and apertures 34 are the same size as apertures 14 and 24 in the connectors of FIGS. 1 and 2. Contact pins 36 are supported within apertures 34 by plastic contact-retention means 38 which supports the contacts within the apertures and provides a hermetic seal between the contacts and side walls 39 of the apertures. Plastic contact-retention means 38 comprises a molded body of suitable moldable, thermosetting dielectric material such as preferably glass-filled epoxy resin, such as PLASKON molding compound, EPIALL 1904 (product of Allied Chemical, Morristown, New Jersey). The molded body includes plug portions **38*a* within apertures 34 and an integral, external covering portion 38*b* which extends out the ends of the apertures and covers at least portions of opposite surfaces 41 and 42 of support member 32**.

The glass-filled epoxy resin can be molded at temperatures of approximately 143°-177° C. (290°-350° F.), substantially lower than a temperature of about 913° C. (1675° F.) needed to melt conventional glass material.

External covering portion 38b permits excessively thin-wall portions in the contact-retention means 38 to be avoided. Each contact 36 includes a pair of contact flanges 36a, 36b axially spaced outwardly from first and second opposed surfaces 41, 42 of transverse plate portion 32 increasing the minimum distance between the metal of contact flanges 36a, 36b and the metal of transverse plate portion 32. Specifically, as shown in FIG. 3, the thickness of the plastic material between flange portions 36a, 36b of contacts 36 and side walls 39 of the apertures (as indicated at 35) is substantially greater than in the embodiment of FIG. 2 to ensure reliable molding characteristics without increasing the size of the apertures and without changing the standard center line spacing between contacts.

As in the embodiment of FIG. 2, a plastic-to-metal adhesive 37 such as vinyl phenolic or nylon phenolic resin is preferably applied at the interface between plug portions 38a and the adjacent contact portions, and between plug portions 38a and side walls 39 of the apertures, and may be provided at other interfaces between plastic body 38 and metal support member 32. A preferable method of applying such a resin would be to coat those metal surfaces to interface ultimately with the plastic plug or covering, and then precure the sealing resin prior to the insert molding process, which may be an injection molding process. Such a method of precoating of sealant on contact surfaces is disclosed in U.S. Pat. No. 3,522,575.

Figure 4:
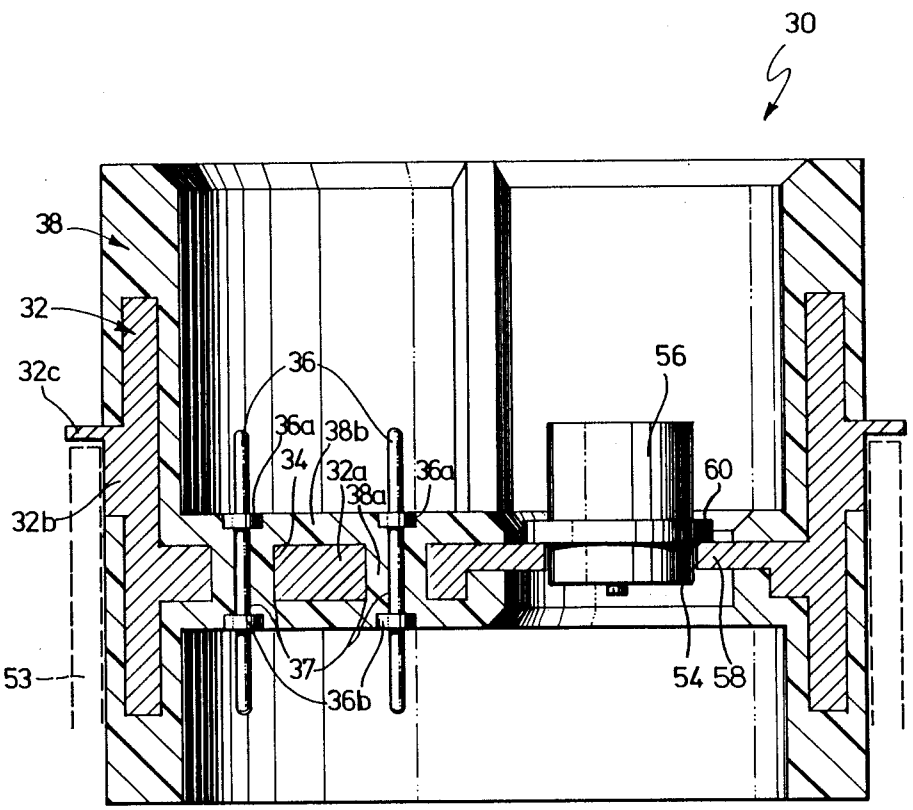
FIG. 4 is a longitudinal sectional view illustrating the connector of FIG. 3 in more complete detail.

FIG. 4 illustrates connector 30 of FIG. 3 more comprehensively. Connector 30 comprises a multiple contact interface connector for high-voltage applications or the like. As shown in FIG. 4, tubular metal support member 32 includes a transverse flat plate portion 32a; an integral annular rim portion 32b; about the outside surface of tubular support member 32 and an annular flange portion 32c which extends transversely outwardly from rim portion 32b for electrical connection by soldering or the like to an outer metallic housing or cap (illustrated schematically in dotted line at 53) as is known to those skilled in the art. In FIG. 4, flange portion 32c is positioned on a different plane than plate portion 32a through flange portion 32c may be coplanar with plate portion 32a, if desired.

Plate portion 32a is adapted to support any desired plurality of contacts 36, and may also include one or more apertures 54 for receipt of coaxial cable contact assemblies 56 or other electrical components. Aperture 54 through transverse plate portion 32 may remain unfilled by plug material, exposing a peripheral annulus 58 defined by transverse plate portion 32 for mechanical and electrically grounding connection of flange 60 of an outer conductor of coaxial cable contact assembly 56 disposed in aperture 54, such as by soldering. The annular flange 32c now serves to provide a ground connection to can 53.

As shown in FIG. 4, plastic contact-retention means 38 is molded onto and around metal support means 32 such that it covers substantially the entire surface thereof including plate portion 32a and annular rim portion 32b with only outwardly extending flange portion 32c being left uncovered so that it may be connected to can 53. Contact-retention means 38 thus includes plug portions 38a within apertures 34 to support contacts 36 and provide a hermetic seal between the contacts and the side walls of apertures 34, and an external covering portion 38b which covers and encapsulates substantially the entire interface connector to help protect and seal the connector. Contact-retention means 38 can be molded by placing support member 32 in a suitable mold, positioning the contacts centrally within the apertures, and molding the plastic material in a conventional manner.

While what has been described constitute presently preferred embodiments, it should be understood that the invention could take numerous other forms. For example, although the invention has been primarily described in connection with a multiple contact interface connector, the invention can be incorporated in other types of connectors which require hermetic sealing. Also, if desired, additional contact flange portions may be formed on contacts 36 to further increase the surface area at the interface between the contacts and the plastic plugs. Because the invention can take numerous forms, it should be recognized that the invention should be limited only insofar as is required by the scope of the following claims.

I claim:

1. A hermetically sealed electrical connector of the type adapted to be mounted in an opening of a surrounding conductive member and suitable for high voltage applications at elevated in-service temperatures, comprising:

a support member comprised of metal having a known coefficient of thermal expansion, said support member having a transverse flat plate portion having at least one aperture extending therethrough, an annular metal rim portion surrounding said plate portion, and an annular metal flange portion extending outwardly from said rim portion at a location axially spaced from said transverse flat plate portion, said transverse flat plate portion being free of outwardly extending flanges peripherally about said at least one aperture;

an electrical contact extending through each said at least one aperture and having contact sections exposed on both sides of said transverse flat plate portion for electrical connection;

contact-retention means of plastic material selected to have a coefficient of thermal expansion similar to that of said metal of said support member, said contact-retention means being molded and adhered to a respective said contact simultaneously molded and adhered within each said at least one aperture for retaining each said contact within a respective said at least one aperture and for providing a hermetic seal between each said contact and said support member; and each said electrical contact including at least one flange portion for increasing the bonding surface area at the interfaces between each said contact and said respective contact-retention means.

2. The connector of claim 1 wherein each said plastic contact-retention means comprises a respective discrete plastic plug within each said at least one aperture, each said contact extending through and being supported by a respective said plastic plug molded therearound.

3. The connector of claim 2 and further including a plastic-to-metal adhesive applied at the interfaces between each said plastic plug and the side walls of a respective said at least one aperture for providing an enhanced seal therebetween.

4. The connector of claim 1 further including an external covering portion having respective plastic plug portions extending through each said at least one aperture.

5. The connector of claim 4 wherein each said contact includes a pair of contact flanges axially spaced outwardly from first and second opposed surfaces of said transverse plate portion, thus increasing the minimum distance between said contact flanges and said transverse plate portion.

6. The connector of claim 4 wherein said metal support member comprises a flat metal plate portion having opposed first and second surfaces, wherein said at least one aperture comprises a plurality of apertures extending through said plate portion from said first surface to said second surface, and wherein said external covering portion of said plastic contact-retention means covers said first and second surfaces of said flat plate portion.

7. The connector of claim 6 wherein said metal support member further includes an annular metal rim portion along an outer surface of said support member and an annular metal flange portion extending transversely outwardly around said metal rim portion, and wherein said external covering portion of said plastic contact-retention means also covers said annular rim portion, said annular metal flange portion being left uncovered for being mounted to and along a corresponding transverse portion of a surrounding conductive member.

8. The connector of claim 1 wherein said connector comprises an interface connector.

9. A hermetically sealed electrical interface connector suitable for high voltage applications at elevated in-service temperatures, comprising:

a support member comprised of metal having a known coefficient of thermal expansion, said support member including a transverse flat plate portion, an annular metal rim portion surrounding said plate portion, and an annular metal flange portion extending outwardly from said rim portion at a location axially spaced from said transverse flat plate portion for connection to a surrounding conductive member, said plate portion having a plurality of apertures extending therethrough from a first surface of said plate portion to the opposed second surface thereof, said plate portion being free of flanges extending outwardly from peripherally about each of said apertures;

an electrical contact extending through each of said apertures and having contact sections exposed on both sides of said transverse flat plate portion for electrical connection;

a molded plastic body substantially surrounding said support member, said molded plastic body including a plurality of plug portions within said plurality of apertures for supporting said plurality of contacts within said apertures and for providing a hermetic seal between said contacts and the side walls of said apertures, and an external covering portion covering said first and second surfaces of said plate portion and said annular rim, said metal flange portion of said support member being left uncovered for connection to said surrounding conductive member, said body being molded of plastic having a coefficient of thermal expansion similar to that of said metal of said support member; and each said electrical contact including at least one contact flange portion for increasing the bonding surface at the interface between said contact and said plug portion.

10. The connector of claim 9 wherein each said contact includes a pair of contact flanges axially spaced outwardly from said first and second surfaces of said transverse plate portion increasing the minimum distance between said contact flanges and said transverse plate portion.

11. The connector of claim 9 and further including a metal-to-plastic adhesive applied at the interface between the plug portions and the side walls of said apertures for providing an enhanced bond therebetween.

12. The connector of claim 9 wherein a selected aperture through said flat plate portion remains unfilled by a said plug portion, exposing a peripheral annulus for mechanical and electrically grounding connection of an outer conductor of a coaxial cable contact assembly disposed in said selected aperture.

* * * * *